United States Patent [19]

Goodman et al.

[11] Patent Number: 4,998,543

[45] Date of Patent: Mar. 12, 1991

[54] SMOKING ARTICLE EXHIBITING REDUCED SIDESTREAM SMOKE, AND WRAPPER PAPER THEREFOR

[76] Inventors: Barbro L. Goodman, 17310 Branders Bridge Rd., Colonial Heights, Va. 23834; Willie G. Houck, Jr., 7753 Lake Forest Dr., Richmond, Va. 23235

[21] Appl. No.: 361,245

[22] Filed: Jun. 5, 1989

[51] Int. Cl.[5] ..... A24D 1/02

[52] U.S. Cl. ..... 131/365

[58] Field of Search ..... 131/365, 358, 331, 343; 162/123, 125, 128, 139

[56] References Cited

U.S. PATENT DOCUMENTS

| | | |
|---|---|---|
| Re. 32, 615 | 3/1988 | Luke . |
| 637,419 | 11/1899 | Richmond . |
| 2,580,568 | 1/1952 | Matthews et al. . |
| 2,580,608 | 1/1952 | Schur et al. . |
| 2,580,610 | 1/1952 | Schur et al. . |
| 3,370,593 | 2/1968 | Owaki . |
| 3,395,714 | 8/1968 | Kahane . |
| 3,409,021 | 11/1968 | Owaki . |
| 3,586,005 | 6/1971 | Lippman, Jr. et al. . |
| 3,633,589 | 1/1972 | Kahane et al. . |
| 3,744,496 | 7/1973 | McCarty et al. . |
| 4,088,142 | 5/1978 | Horsewell et al. . |
| 4,108,151 | 8/1978 | Martin et al. . |
| 4,129,134 | 12/1978 | Hind et al. . |
| 4,146,040 | 3/1979 | Cohn . |
| 4,187,862 | 2/1980 | Cohn . |
| 4,225,636 | 9/1980 | Cline et al. . |
| 4,231,377 | 11/1980 | Cline et al. . |
| 4,407,308 | 10/1983 | Baker et al. . |
| 4,420,002 | 12/1983 | Cline . |
| 4,433,697 | 2/1984 | Cline et al. . |
| 4,450,847 | 5/1984 | Owens . |
| 4,453,553 | 6/1984 | Cohn . |
| 4,461,311 | 7/1984 | Mathews et al. . |
| 4,489,738 | 12/1984 | Simon . |
| 4,505,282 | 3/1985 | Cogbill et al. . |
| 4,548,677 | 10/1985 | Schneider et al. . |
| 4,561,454 | 12/1985 | Guess . |
| 4,607,647 | 8/1986 | Dashley et al. . |
| 4,615,345 | 10/1986 | Durocher . |
| 4,622,983 | 11/1986 | Mathews et al. . |
| 4,624,268 | 11/1986 | Baker et al. . |
| 4,679,575 | 7/1987 | Yamaguchi et al. . |
| 4,691,717 | 9/1987 | Ikeda et al. . |
| 4,721,120 | 1/1988 | Greig et al. . |
| 4,779,631 | 10/1988 | Durocher et al. . |
| 4,805,644 | 2/1989 | Hampl, Jr. et al. . |

*Primary Examiner*—V. Millin

*Attorney, Agent, or Firm*—Robert R. Jackson; John E. Schneider

[57] ABSTRACT

The sidestream smoke associated with a cigarette or cigarette-like smoking article is reduced by wrapping the tobacco in a double layer of paper. Each layer includes calcium carbonate (i.e., about 30–40% by weight in the outer paper and about 2–15% by weight in the inner paper, the calcium carbonate in the outer paper having a surface area of about 20–80 square meters per gram by the BET method) and a burn control chemical. The outer layer also preferably includes monoammonium phosphate and sodium carboxy methyl cellulose. The calcium carbonate employed has a relatively high surface area per unit weight. The porosity of the outer layer is about 50–100 cubic centimeters per minute by the Coresta method, and may be adjusted by electrostatic perforation.

27 Claims, 1 Drawing Sheet

FIG. 1
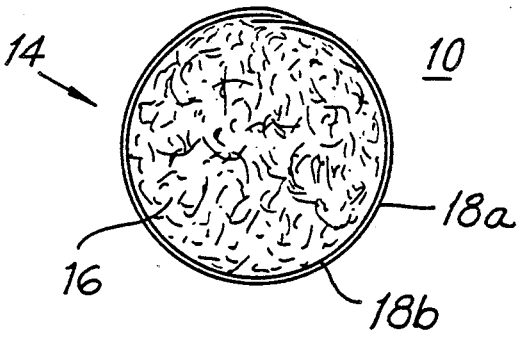
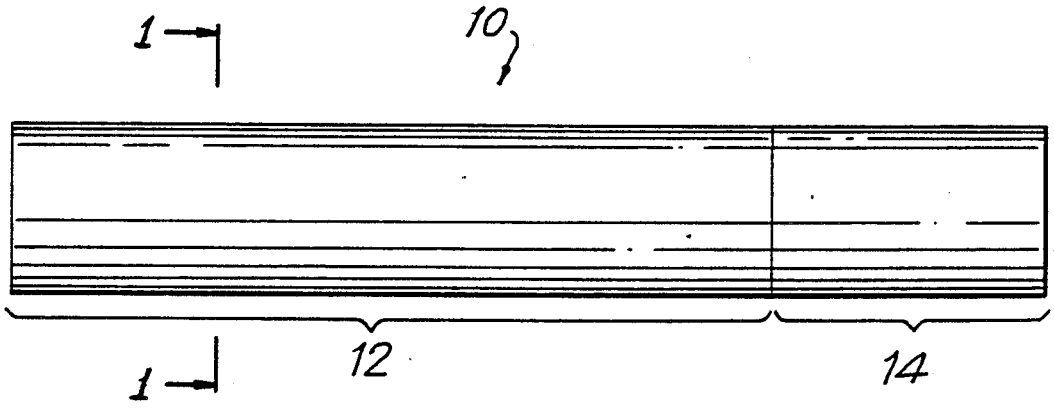
FIG. 2

SMOKING ARTICLE EXHIBITING REDUCED SIDESTREAM SMOKE, AND WRAPPER PAPER THEREFOR

BACKGROUND OF THE INVENTION

This invention relates to smoking articles such as cigarettes, and more particularly to cigarettes or cigarette-like smoking articles having reduced sidestream smoke.

Sidestream smoke is the smoke given off by the burning end of a cigarette or cigarette-like smoking article between puffs. Such smoke may be objectionable to those near the smoker who are not smoking or who do not smoke.

It is therefore an object of this invention to reduce the amount of sidestream smoke associated with cigarettes or cigarette-like smoking articles.

It is another object of this invention to provide cigarettes or cigarette-like smoking articles having reduced sidestream smoke.

SUMMARY OF THE INVENTION

These and other objects of the invention are accomplished in accordance with the principles of the invention by providing a cigarette or cigarette-like smoking article having a double wrapping of paper around the tobacco. The outer paper has a basis weight of about 30–70 (preferably about 50) grams per square meter, an initial porosity of about 2–10 (preferably about 5) cubic centimeters per minute by the Coresta method, a calcium carbonate filler loading of about 30–40% (preferably about 35%) by weight employing calcium carbonate having a surface area of about 20–80 (preferably about 25) square meters per gram by the BET method, a burn chemical additive (such as succinate, citrate, or any other alkali metal burn chemical known to those in the industry) of about 2–10% (preferably about 5.5% succinate) by weight, about 0–1% (preferably about 0.6%) by weight monoammonium phosphate, and about 0–1% (preferably about 0.3%) by weight sodium carboxy methyl cellulose. The porosity of the outer paper is increased to about 50–100 (preferably about 60) cubic centimeters per minute by the Coresta method, e.g., by electrostatic perforation. The inner paper has a basis weight of about 15–25 (preferably about 18) grams per square meter, a porosity of about 20–40 (preferably about 30) cubic centimeters per minute by the Coresta method, a calcium carbonate loading of about 2–15% (preferably about 3%) by weight, and a burn chemical additive (such as succinate, citrate, or any other alkali metal burn chemical known to those in the industry) of about 0–2% (preferably about 0.6% citrate) by weight.

Further features of the invention, its nature and various advantages will be more apparent from the accompanying drawings and the following detailed description of the preferred embodiments.

BRIEF DESCRIPTION OF THE DRAWINGS

FIG. 1 is a simplified cross sectional view (taken along the line 1—1 in FIG. 2) of an illustrative embodiment of a cigarette constructed in accordance with the principles of this invention.

FIG. 2 is a simplified elevational view of an illustrative embodiment of a cigarette constructed in accordance with the principles of this invention.

DETAILED DESCRIPTION OF THE PREFERRED EMBODIMENTS

As shown in FIGS. 1 and 2, a cigarette 10 constructed in accordance with this invention includes tobacco rod 12 and filter 14. Tobacco rod 12 has a filling of tobacco 16 surrounded by two layers of paper 18*a* and 18*b*. Outer layer 18*a* is preferably slightly wider than inner layer 18*b* to ensure that the inner layer is completely covered by the outer layer in the finished cigarette. Filter 14 is entirely optional and can be omitted if desired.

Outer paper 18*a* has a basis weight of about 30–70 (preferably about 50) grams per square meter. It has an initial porosity of about 2–10 (preferably about 5) cubic centimeters of air per minute as determined by the industry-standard Coresta method. Outer paper 18*a* is made with a calcium carbonate filler loading of about 30–40% (preferably about 35%) by weight. The calcium carbonate used has a surface area of about 20–80 (preferably about 25) square meters per gram by the well-known BET method (see, for example, F. M. Nelson et al., "Determination of Surface Area", *Analytical Chemistry,* Vol. 30, No. 8, August 1958, pp. 1387–1390, for a description of the BET method). This is a relatively high surface area for a filler in a cigarette paper. A typical surface area would be about 7–10 square meters per gram.

To help control or determine the puff count of the cigarette, outer paper 18*a* also includes about 2–10% by weight of a burn chemical such as succinate, citrate, or any other alkali metal burn chemical known to those in the industry. The preferred burn chemical additive is about 5.5% by weight succinate. In addition to helping to control or determine the burn rate of the paper, the burn chemical is believed to act as a fluxing or dispersing agent for the calcium carbonate and to combine with the calcium carbonate to help make a relatively air- and smoke-impervious ash. The imperviousness of the ash (which is also promoted by the high surface area of the calcium carbonate) is believed to contribute significantly to the reduction of sidestream smoke.

Outer paper 18*a* also includes about 0–1% (preferably about 0.6%) by weight monoammonium phosphate. This chemical tends to reduce unattractive streaking of the outer paper due to condensation on the inside of the paper following puffs. The tendency of the paper to streak in this manner is increased because the porosity of the paper has been reduced to reduce sidestream smoke. Monoammonium phosphate is used to eliminate this possible cosmetic problem.

Outer paper 18*a* further includes about 0–1% (preferably about 0.3%) by weight sodium carboxy methyl cellulose. This chemical, which acts as a film former, contributes to the imperviousness of the ash, which, as has been mentioned, helps to reduce sidestream smoke. Sodium carboxy methyl cellulose is also believed to act as a carrying agent to help get the burning agent (e.g., succinate) into the paper.

Outer paper 18*a* is perforated (e.g., by conventional electrostatic perforation) to increase its porosity to about 50–100 (preferably about 60) cubic centimeters of air per minute by the Coresta method. Perforation of outer paper 18*a* in this manner improves the mechanical feel of the cigarette. It also provides some pressure relief for the cigarette in order to reduce the amount of smoke coming out of the proximal end of the filter or any perforations in the tipping overwrap between puffs.

The inner paper 18b discussed in detail below minimizes the visible smoke escaping through the perforations in the outer paper.

Inner paper 18b adds another layer to the paper ash to increase its imperviousness and to thereby help reduce sidestream smoke. Inner paper 18b also adds strength to the cigarette and improves its overall appearance. Inner paper 18b has a basis weight of about 15–25 (preferably about 18) grams per square meter. It has a porosity of about 20–40 (preferably about 30) cubic centimeters of air per minute (Coresta). Because of this relatively high porosity, inner paper 18a does not require electrostatic perforation. Inner paper 18b is made with a calcium carbonate filler loading of about 2–15% (preferably about 3%) by weight. This relatively low calcium carbonate loading helps to slow down the burn rate of the inner paper and contributes to reducing the amount of visible smoke that would otherwise come out the perforations in the outer paper. To help control or determine the burn rate of the paper, inner paper 18b also includes about 0–2% by weight of a burn chemical such as succinate, citrate, or any other alkali metal burn chemical known to those in the industry. The preferred burn chemical additive is about 0.6% by weight citrate.

It will be apparent that the foregoing is merely illustrative of the principles of this invention and that various modifications can be made by those skilled in the art without departing from the scope and spirit of the invention. For example, although succinate and citrate have been mentioned as possible burn control chemicals, other conventional burn control chemicals can be used if desired.

We claim:

1. A cigarette comprising a tobacco rod surrounded by inner and outer layers of paper formulated to reduce the amount of sidestream smoke produced by the cigarette, said outer layer of paper having a basis weight of about 30–70 grams per square meter, an initial porosity of about 2–10 cubic centimeters per minute by the Coresta method, a calcium carbonate filler loading of about 30–40% by weight employing calcium carbonate having a surface area of about 20–80 square meters per gram by the BET method, about 2–10% by weight of a burn chemical, about 0–1% by weight of monoammonium phosphate, and about 0–1% by weight of sodium carboxy methyl cellulose, said outer paper being perforated to increase its porosity to about 50–100 cubic centimeters per minute by the Coresta method, said inner layer of paper having a basis weight of about 15–25 grams per square meter, a porosity of about 20–40 cubic centimeters per minute by the Coresta method, a calcium carbonate filler loading of about 2–15% by weight, and about 0–2%, by weight of a burn chemical.

2. The cigarette defined in claim 1 wherein said outer layer of paper has a basis weight of about 50 grams per square meter.

3. The cigarette defined in claim 1 wherein said outer layer of paper has an initial porosity of about 5 cubic centimeters per minute by the Coresta method.

4. The cigarette defined in claim 1 wherein said outer layer of paper has a calcium carbonate filler loading of about 35% by weight.

5. The cigarette defined in claim 1 wherein the calcium carbonate used as a filler in said outer layer of paper has a surface area of about 25 square meters per gram by the BET method.

6. The cigarette defined in claim 1 wherein said burn chemical in said outer layer of paper is selected from the group consisting of succinate, citrate, and other alkali metal burn chemicals.

7. The cigarette defined in claim 6 wherein said outer layer of paper has about 5.5% by weight succinate as said burn chemical.

8. The cigarette defined in claim 1 wherein said outer layer of paper has about 0.6% by weight monoammonium phosphate.

9. The cigarette defined in claim 1 wherein said outer layer of paper has about 0.3% by weight sodium carboxy methyl cellulose.

10. The cigarette defined in claim 1 wherein the porosity of said outer layer of paper is increased to about 60 cubic centimeters per minute by the Coresta method.

11. The cigarette defined in claim 1 wherein the porosity of said outer layer of paper is increased by electrostatic perforation.

12. The cigarette defined in claim 1 wherein said inner layer of paper has a basis weight of about 18 grams per square meter.

13. The cigarette defined in claim 1 wherein said inner layer of paper has a porosity of about 30 cubic centimeters per minute by the Coresta method.

14. The cigarette defined in claim 1 wherein said inner layer of paper has a calcium carbonate filler loading of about 3% by weight.

15. The cigarette defined in claim 1 wherein said burn chemical in said inner layer of paper is selected from the group consisting of succinate, citrate, and other alkali metal burn chemicals.

16. The cigarette defined in claim 15 wherein said inner layer of paper has about 0.6% by weight citrate as said burn chemical.

17. A cigarette wrapper for helping to reduce sidestream smoke produced by a cigarette wrapped with paper, said paper having a basis weight of about 30–70 grams per square meter, an initial porosity of about 2–10 cubic centimeters per minute by the Coresta method, a calcium carbonate filler loading of about 30–40% by weight employing calcium carbonate having a surface area of about 20–80 square meters per gram by the BET method, about 2–10% by weight of a burn chemical, about 0–1% by weight monoammonium phosphate, and about 0–1% by weight of sodium carboxy methyl cellulose, said paper being perforated to increase its porosity to about 50–100 cubic centimeters per minute by the Coresta method.

18. The paper defined in claim 17 wherein said basis weight is about 50 grams per square meter.

19. The paper defined in claim 17 wherein said initial porosity is about 5 cubic centimeters per minute by the Coresta method.

20. The paper defined in claim 17 wherein said calcium carbonate filler loading is about 35% by weight.

21. The paper defined in claim 17 wherein said calcium carbonate has a surface area of about 25 square meters per gram by the BET method.

22. The paper defined in claim 17 wherein said burn chemical is selected from the group consisting of succinate, citrate, and other alkali metal burn chemicals.

23. The paper defined in claim 22 wherein said burn chemical is about 5.5% by weight succinate.

24. The paper defined in claim 17 wherein said paper has about 0.6% by weight monoammonium phosphate.

25. The paper defined in claim 17 wherein said paper has about 0.3% by weight sodium carboxy methyl cellulose.

26. The paper defined in claim 17 wherein the porosity of said paper is increased to about 60 cubic centimeters per minute by the Coresta method.

27. The paper defined in claim 17 wherein the porosity of said paper is increased by electrostatic perforation.

* * * * *